US005954529A

United States Patent [19]

Meller

[11] Patent Number: 5,954,529

[45] Date of Patent: Sep. 21, 1999

[54] CONNECTOR WITH SPRING CONTACT MEMBER AND SHORTING MEANS

[75] Inventor: Andrew G. Meller, HK Vlijmen, Netherlands

[73] Assignee: Berg Technology, Inc., Reno, Nev.

[21] Appl. No.: 08/849,308

[22] PCT Filed: Dec. 20, 1995

[86] PCT No.: PCT/US95/16429

§ 371 Date: May 20, 1997

§ 102(e) Date: May 20, 1997

[87] PCT Pub. No.: WO96/19853

PCT Pub. Date: Jun. 27, 1996

[51] Int. Cl.[6] ..... H01R 29/00

[52] U.S. Cl. ..... 439/188

[58] Field of Search ..... 439/188, 482, 439/289, 700, 824, 66, 357, 919, 929

[56] References Cited

U.S. PATENT DOCUMENTS

| | | | |
|---|---|---|---|
| 2,922,948 | 1/1960 | Washburn | 324/437 |
| 3,903,385 | 9/1975 | Moyer et al. | 200/51.1 |
| 4,070,557 | 1/1978 | Ostapovitch | 200/51.1 |
| 4,161,346 | 7/1979 | Cherian et al. | 439/66 |
| 4,179,178 | 12/1979 | Bachman et al. | 439/59 |
| 4,199,209 | 4/1980 | Cherian et al. | 439/591 |
| 4,307,928 | 12/1981 | Petlock, Jr. | 439/824 |
| 4,358,173 | 11/1982 | Conrad | 439/71 |
| 4,359,252 | 11/1982 | Olsson et al. | 439/71 |
| 4,533,203 | 8/1985 | Feldman et al. | 439/64 |
| 4,634,199 | 1/1987 | Anhalt et al. | 439/69 |
| 4,647,126 | 3/1987 | Sobota, Jr. | 439/74 |
| 4,708,659 | 11/1987 | Wozniczka | 439/62 |
| 4,734,051 | 3/1988 | Burns | 439/289 |
| 4,752,251 | 6/1988 | Kato et al. | 439/752 |
| 4,773,877 | 9/1988 | Kruger et al. | 439/482 |
| 4,778,404 | 10/1988 | Pass | 439/387 |
| 4,954,087 | 9/1990 | Lauks et al. | 439/71 |
| 4,978,311 | 12/1990 | Oda et al. | 439/188 |
| 5,090,117 | 2/1992 | Dickie | 29/840 |
| 5,167,512 | 12/1992 | Walkup | 439/66 |
| 5,358,411 | 10/1994 | Mroczkowski et al. | 439/66 |
| 5,409,387 | 4/1995 | Northey et al. | 439/188 |
| 5,807,123 | 9/1998 | Splegelaar et al. | 439/188 |

FOREIGN PATENT DOCUMENTS

| | | |
|---|---|---|
| 0718 918 A1 | 5/1995 | European Pat. Off. . |
| 3507 464 A1 | 3/1985 | Germany . |
| 695 00 525 T2 | 5/1995 | Germany . |
| 2 234 403 | 1/1991 | United Kingdom . |

OTHER PUBLICATIONS

8182 Motorola Technical Developments 15 (1992) May, Schaumburg, Illinois, US Technical Developments vol. 15—p. 41.

IBM Technical Disclosure Bulletin, vol. 17, No. 2—Jul. 1974—pp. 444, 445.

*Primary Examiner*—Steven L. Stephan
*Assistant Examiner*—Barry M. L. Standig
*Attorney, Agent, or Firm*—Daniel J. Long; M. Richard Page

[57] ABSTRACT

Connector block (3) comprising at least one contact member (22) provided with a first contact terminal (10) for electrical contact to a contact terminal (6) of a mating connector (2), a second contact terminal (9) and a spring part (13) giving the contact member a resilient capacity in its axial direction, the first contact terminal (10), the second contact terminal (9) and the spring part (13) being integrally made and the spring part (13) having a corrugated structure; separate ground means (19, 19') are arranged to provide a static discharge capacity for vulnerable electronic components connected to the second contact terminals (9).

12 Claims, 8 Drawing Sheets

X = Y

Y > X

Y < X fig-9
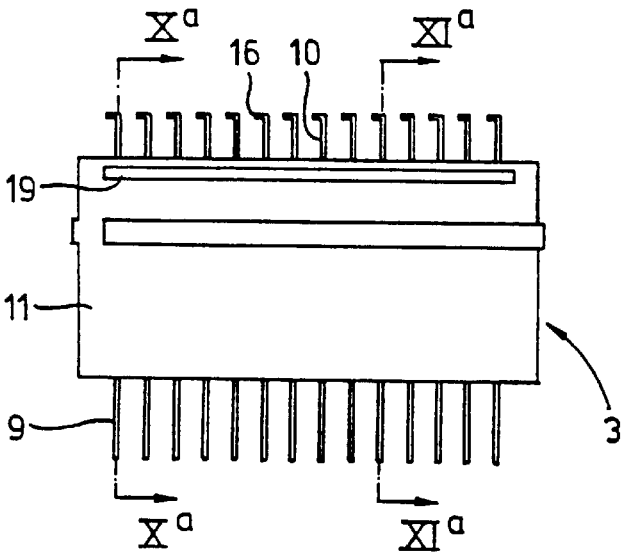
fig-10b fig-11b
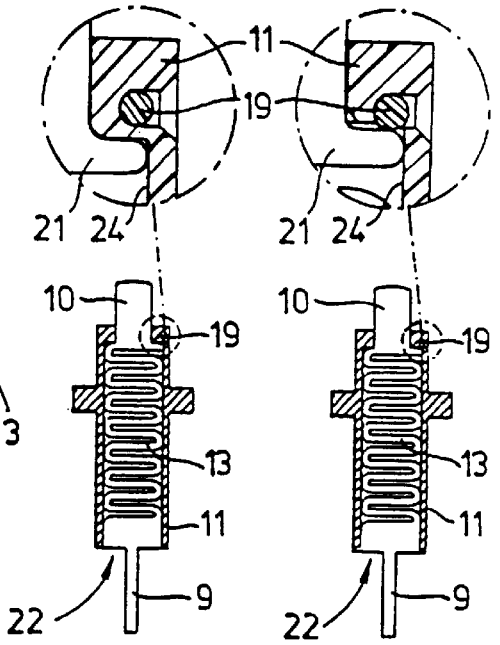
fig-12a
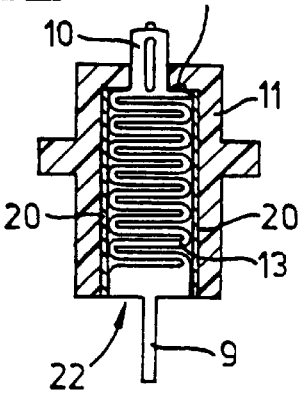
fig-10a fig-11a
fig-12c
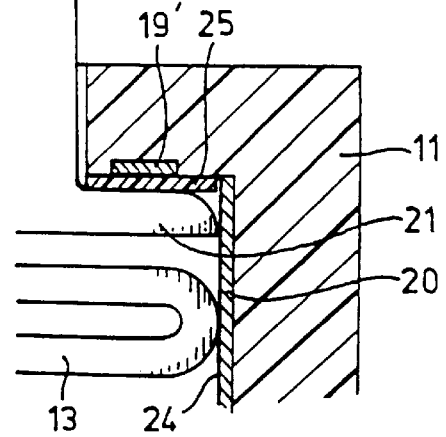
fig-12b
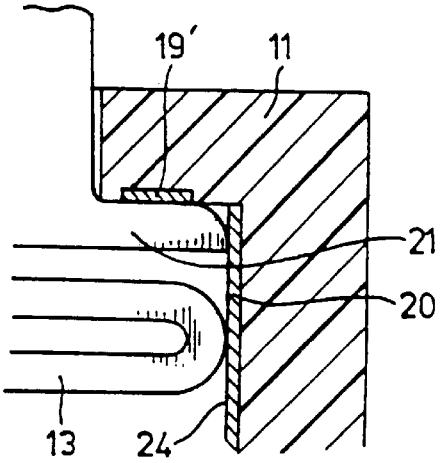

CONNECTOR WITH SPRING CONTACT MEMBER AND SHORTING MEANS

BACKGROUND OF THE INVENTION

The present invention relates to a connector block comprising at least one contact member, each contact member being integrally made and provided with a first contact terminal for electrical contact to a contact member of a mating electric element, a second contact terminal and a spring part giving the contact member a resilient capacity in a predetermined axial direction, the connector block also comprising a shorting rod electrically contacting predetermined contact members when the connector block is in its disconnected state and being electrically separated from said predetermined contact members when the connector block is in its connected state. Such a connector block is known from U.S. Pat. No. 4,954,087 which is intended for test purposes and to identify electric components which are able to push away predetermined first terminals from the shorting rod in the testing state. The shorting rod in this prior art connector block is not intended to short circuit vulnerable electronic equipment, such as MOS elements, when the connector block is in its disconnected state. Moreover, the known short rod extends in an open space in the connector block and the spring parts of the contact elements occupy a large space. Thus, the design of the known connector block is unsuitable for miniaturization.

U.S. Pat. No. 3,903,385 shows a connector provided with opposite pairs of electrical contact members which are "shorted" by a shorting bar assembly when the connector is not connected to a printed circuit board. The shorting bar assembly comprises a shorting bar extending substantially perpendicular to the longitudinal direction of the contact members. The shorting bar is supported by a spring pushing the shorting bar against both contact members which are somewhat bent to one another for that purpose, whenever a printed circuit board is absent. Inserting a printed circuit board into the connector pushes the shorting bar away from the contact members. Since each contact member is made up of two opposite parts and each pair of contact members needs its own shorting bar with a spring the known shorting bar assembly is unsuitable for miniaturization.

U.S. Pat. No. 4,070,557 discloses a shroud, e.g. used in back panel systems, in which resilient bridging contact members are provided. When no connector is inserted in the shroud the bridging contact members are forced in electrical contact with preselected terminals to form a closed loop condition in vacant module positions. When a connector is inserted into the shroud the connector block pushes the bridging contact members away from the terminals, thus breaking the closed loops. The bridging contact members are U-shaped and need a relatively large space within the shroud making the known arrangement unsuitable for miniaturization.

SUMMARY OF THE INVENTION

Therefore, it is an objective of the present invention to provide a connector with shorting means able to protect vulnerable electronic equipment against static discharges, the connector having a design which allows further miniaturization of the connector and which connector can be easily and relatively cheaply manufactured.

This objective is obtained with a connector block defined above which is characterized in that each spring part has a corrugated structure and is accommodated in a separate cavity within the connector block, the shorting rod extending within the body of the connector block and being partly exposed in predetermined cavities. By providing the shorting rod within the body of the connector block and only exposing it in preselected cavities only very little additional space is required by the shorting rod which serves the purpose of further miniaturization.

In an alternative embodiment the connector block according to the invention comprises at least one contact member, each contact member being integrally made provided with a first contact terminal for electrical contact to a contact member of a mating electric element, a second contact terminal and a spring part giving the contact member a resilient capacity in a predetermined axial direction, the connector block also comprising shorting means electrically contacting predetermined contact members when the connector block is in its disconnected state and being electrically separated from said predetermined contact members when the connector block is in its connected state characterized in that each spring part has a corrugated structure and is accommodated in a separate cavity within the connector block, the shorting means comprising at least one shorting strip extending on the surface of the body of the connector block and being exposed in predetermined cavities. In this embodiment, a very thin shorting strip exposed in preselected cavities is used which also occupies very little space, thus serving the purpose of further miniaturization.

BRIEF DESCRIPTION OF THE DRAWINGS

The present invention will be further illustrated by reference to some drawings showing embodiments of the present invention. The embodiments are only meant to illustrate the present invention and not to limit its scope. In the drawings:

FIG. 6 shows a functional relationship between the force necessary to compress the spring contact member in its axial direction and the compression distance;

FIG. 9 shows a connector with several spring contact members and one ground conductor to establish a static discharge possibility to ground;

FIG. 10*a* shows a cross section along line X—X in FIG. 9;

FIG. 10*b* shows an enlarged view of a detail of FIG. 10*a;*

FIG. 11*a* shows a cross section view along line XI—XI in FIG. 9;

FIG. 11*b* shows an enlarged view of a detail of FIG. 11*a;*

FIG. 12*a* shows a cross section of an alternative embodiment of the connector with a spring contact member according to the invention;

FIG. 12*b* shows a detail of the connector according to FIG. 11*a;*

FIG. 12*c* shows a detail of a cross section through another cavity of the connector according to the embodiment of FIG. 12*a;*

DETAILED DESCRIPTION OF THE PREFERRED EMBODIMENT

Figure 1:
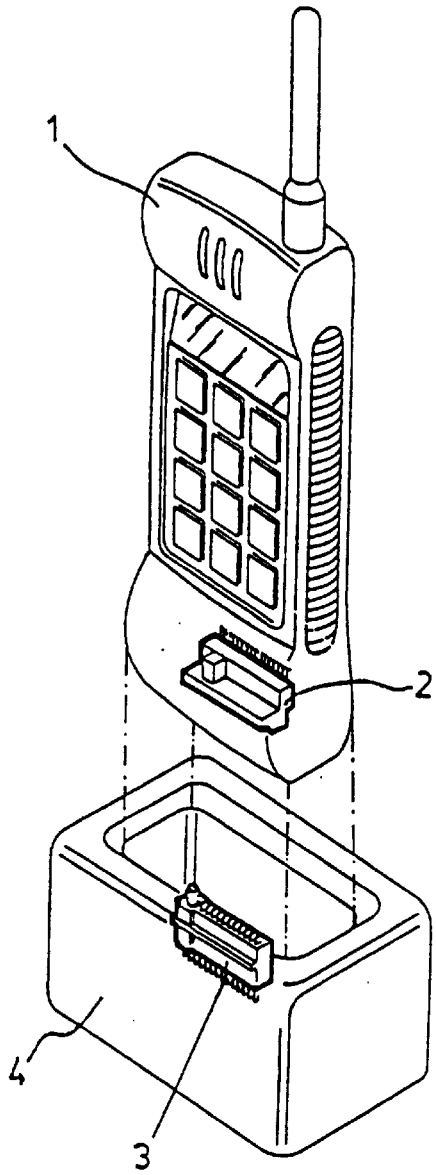
FIG. 1 shows, schematically, a hand-held telephone set according to the prior art.

FIG. 1 shows, schematically, a hand-held telephone set known per se and comprising a telephone cradle 1 and a separate housing 4. The separate housing 4 may have any convenient shape, e.g. a large U-shape able to entirely accommodate the telephone cradle 1. The housing 4 may be fixed to a wall, a dash board of a car, etc. The housing 54 is made of any suitable material, e.g. plastic.

The telephone cradle 1 can be connected to and disconnected from the housing 4. To this end, the telephone cradle 1 is provided with a cradle connector 2 and the housing 4 with a connector block 3. Such a hand-held telephone set must meet very demanding requirements. First of all, the force necessary to connect the telephone cradle to the housing 4 must be as low as possible. Secondly, the electrical connection between the cradle connector 2 and the connector block 3 must be very reliable, even after very many connections and disconnections: the cradle connector 2 and the connector block 3 must be designed for as many connecting and disconnecting operations as at least ten thousand. Thirdly, the cradle connector 2 and the connector block 3 must be designed as small as possible. Sometimes, fifteen or more electrical connections have to be made. However, the overall dimensions of the telephone cradle 1 are largely dependent on the dimensions of the cradle connector 2 and the connector block 3. Especially, the pitch distance between neighboring contact members in the cradle connector 2 and the connector block 3 must be as small as possible. Moreover, the thickness and the width of the cradle connector 2 and the connector block 3 have to be as small as possible. Fourthly, any operator of the telephone cradle 1 must be allowed to connect the telephone cradle 1 to the housing 4 from a beveled position, i.e. from a position in which the length direction of the telephone cradle 1 does not coincide with the axial direction of the contact members of the connector block 3.

Figure 2A:
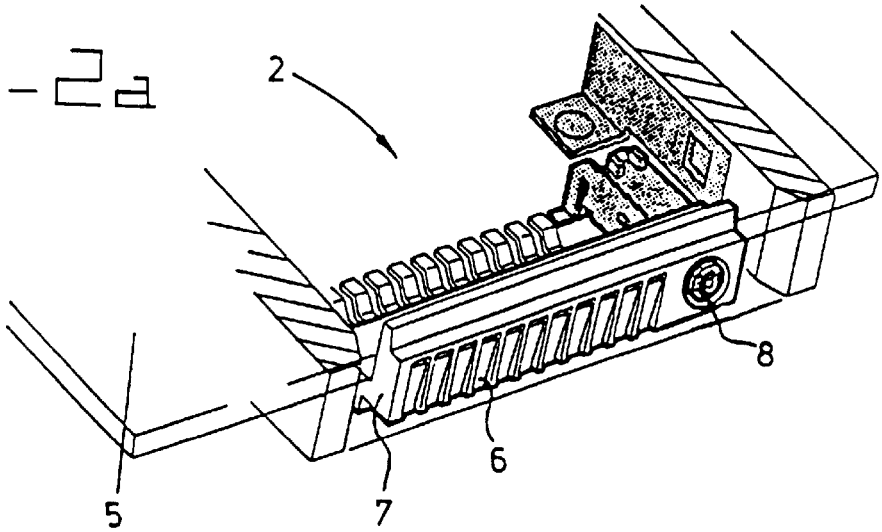
FIGS. 2*a* and 2*b* show connectors used in the prior art arrangement according to FIG. 1.
Figure 2B:
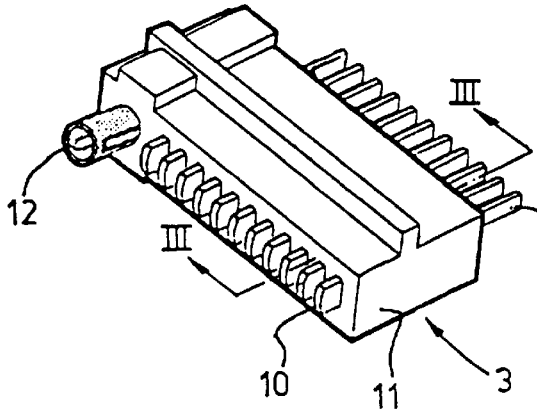

Because of the fourth requirement mentioned above the cradle connector 2 cannot simply be provided with female type terminals to receive male type contact terminals 10 (FIG. 2B) of the connector block 3. The contact terminals 6 of the cradle connector 2 have to be designed in such a way that in the connecting state between the cradle connector 2 and the connector block 3 a sliding contact is provided between the respective contact terminals 6 (FIG. 2A) and the contact terminals 10 (FIG. 2B). Therefore, the contact terminals 6 of the cradle connector 2 are usually provided with flat extremities, as shown in FIG. 2*a*.

The cradle connector 2 and the connector block 3 may be provided with at least one switch coax line for guiding signals which have to be shielded from the outside world.

However, when the option of a sliding contact between the contact terminals 6 and the contact terminals 10 is chosen, each of the contact members of the connector block 3 have to be provided with a spring action in the axial direction of each contact member.

Figure 3:
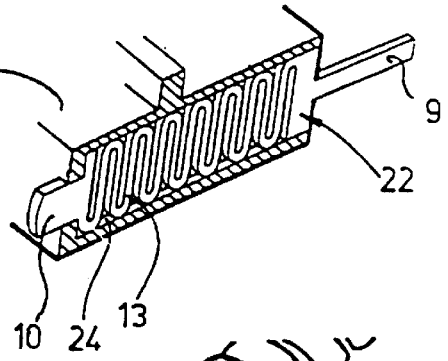
FIG. 3 shows a cross section through a connector block provided with a corrugated spring contact member largely known as such.

FIG. 3 shows a cross section through a connector block 3 along one of the contact members 22. Such a connector block is essentially known from U.S. Pat. No. 4,773,877 albeit for purposes of testing electronic components. The contact member 22 is accommodated within a cavity 24 within the insulating housing 11. The contact member 22 is an integral member comprising a contact terminal 10 for electrical contact to a mating contact terminal 6 (FIG. 2A), a contact pin 9 to be fixed to a printed circuit board in a manner known to any person skilled in the art and a corrugated spring part 13. The contact member shown in FIG. 3 is substantially flat and may, advantageously, be made by stamping from a sheet of thin metal, e.g. made of phosphor bronze.

Figure 4:
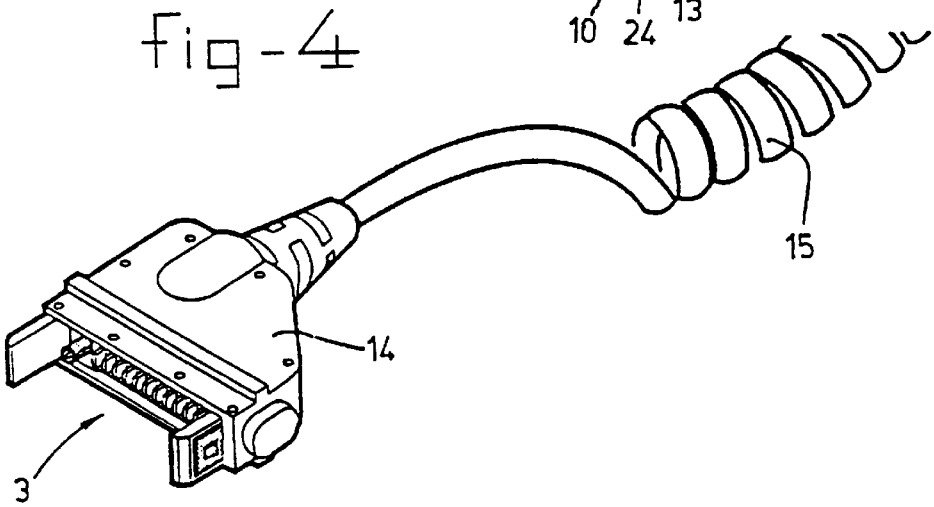
FIG. 4 shows a connector block according to FIG. 3 accommodated within a connector housing connected to a conventional cable.

The connector block 3 may be arranged in a housing as shown in FIG. 1. However, the connector block 3 shown in FIG. 3 may also be accommodated within the housing 14 of a connector connected to a cable 15, as shown in FIG. 4. There is no restriction as to the location where the connector block 3 of FIG. 3 may be arranged. Moreover, there is no restriction as to the number of spring contact members 22 within the housing 11 of the connector block 3, or their arrangement within the connector block 3. Like the prior art connector block 3, shown in FIG. 2*b,* the connector block 3 according to the invention may be provided with one or more switch coax lines 12 or any other kind of contact members.

Figure 5A:
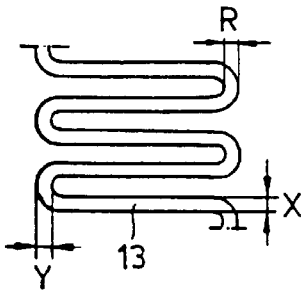
FIGS. 5*a,* 5*b,* 5*c* show different embodiments of the spring part of the spring contact member.

FIG. 5*a* shows a side view of several legs of a corrugated spring part 13 of a spring contact member 22. The corrugated spring part 13 comprises several adjacent U-shapes, adjacent U-shapes being oppositely arranged. In FIG. 5*a* R designates a radius of each U-shape base. Reference sign X designates the width of each of the legs, whereas reference sign Y designates the width of each of the bases. In the arrangement according to FIG. 5*a* the following relation holds: Y=X.

Figure 5B:
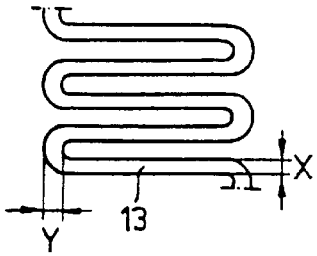
Figure 5C:
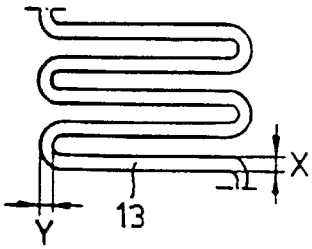
Figure 5:
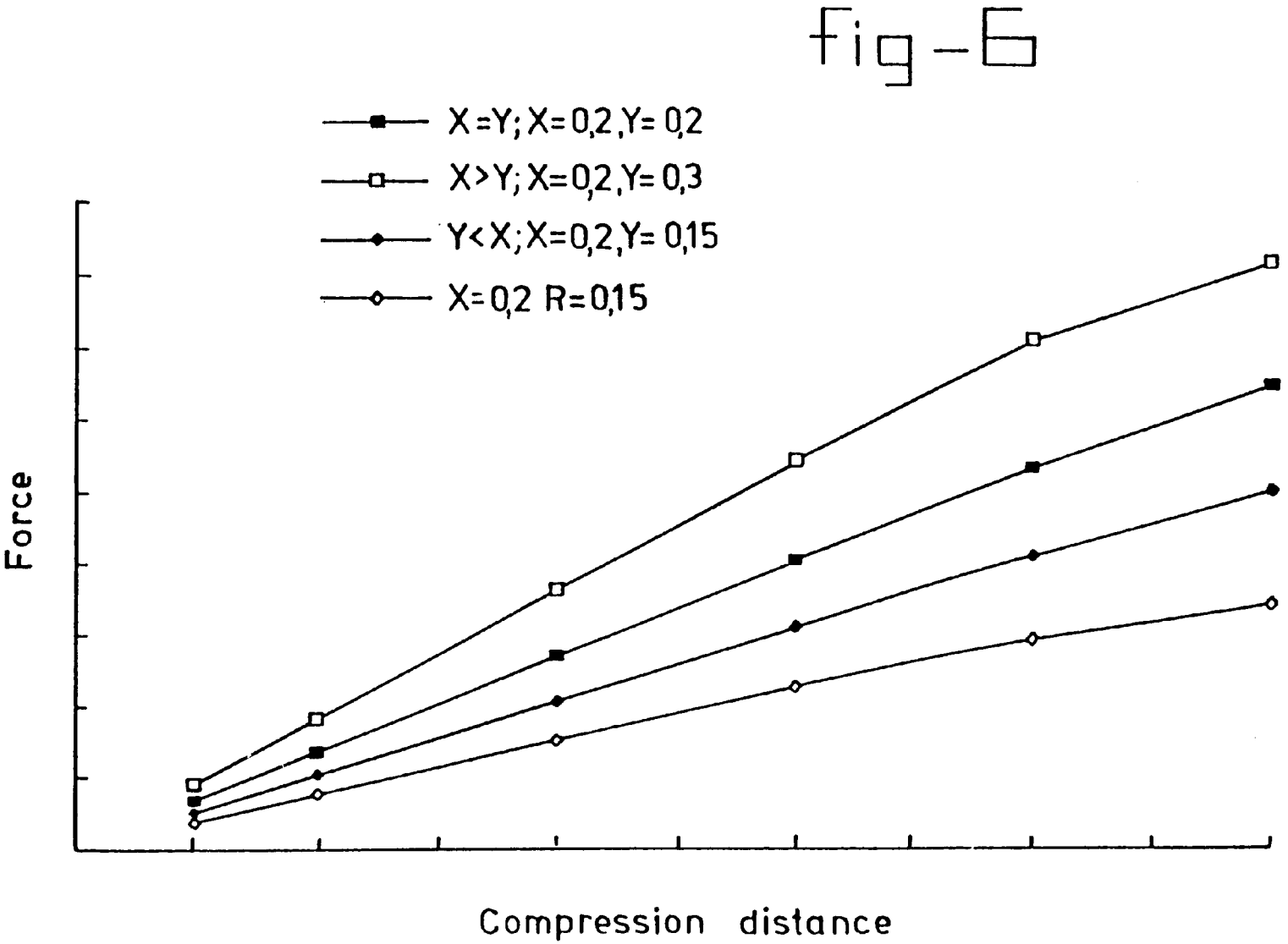

FIG. 5*b* and 5*c* show alternative embodiments of the corrugated spring part 13 of a spring contact member 22. Reference signs X and Y designate the same dimensions as in FIG. 5*a*. In the embodiment shown in FIG. 5*b* the relation Y>X holds, whereas in the embodiment shown in FIG. 5*c* the relation Y<X holds.

By varying the radius R and the width X of the legs, and the width Y of the base the force necessary to compress the spring contact member 22 may be varied. FIG. 6 shows a functional relationship between said force and the compression distance for some selected dimensions of X, Y, and R. The dimensions given are in millimeters. Of course, the relationship shown in FIG. 6 also depends on the material from which the spring contact member 22 is made. Preferably, the force necessary to compress the spring contact member 22 is constant, and independent of the compression distance. However, in practice this is not possible. The dimensions of X, Y, and R are preferably chosen in such a way that the force necessary to compress the spring contact member 22 is between 0.2 and 0.4 Newton.

Figure 7A:
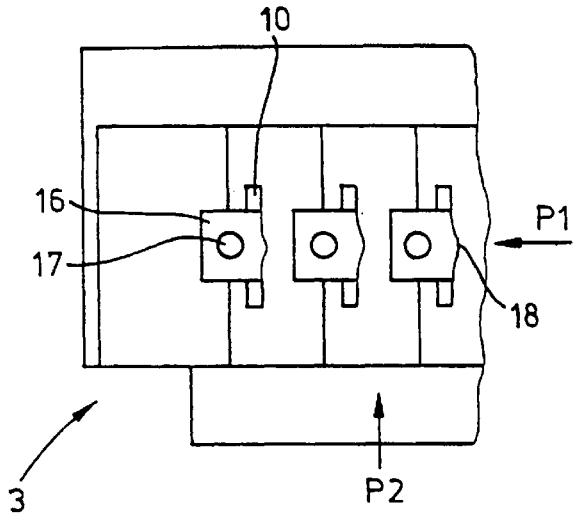
FIG. 7*a* shows a top view of one embodiment of the spring contact member.
Figure 7B:
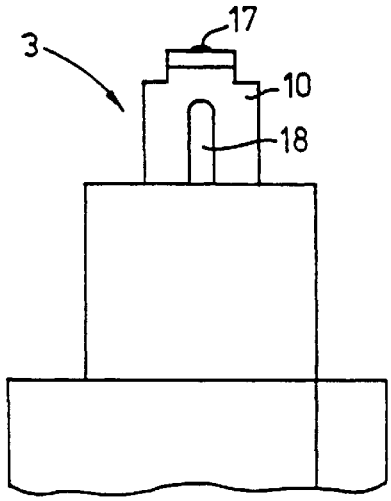
FIG. 7*b* shows a side view of the spring contact member according to FIG. 7*a;*
Figure 7C:
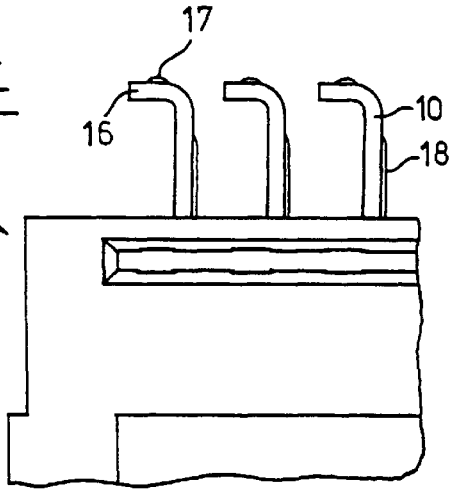
FIG. 7*c* shows a side view of the spring contact member according to FIG. 7*a* but perpendicular to the side view of FIG. 7*b;*

FIG. 7*a* shows a further embodiment of a connector block 3. FIG. 7*a* shows a top view, whereas FIG. 7*b* shows a side view in the direction of arrow P1 in FIG. 7*a* and FIG. 7*c* shows another side view in the direction of arrow P2 in FIG. 7*a*. Arrows P1 and P2 are perpendicular to each other. In the embodiment of FIGS. 7*a*, 7*b*, and 7*c* each of the contact terminals 10 is provided with a bent extremity 16 in order to establish a less sharp contact member 10 and to enhance the possible number of connecting and disconnecting operations between the connector block 3 and the mating cradle connector 2 (FIG. 2A). Preferably each of the bent extremities 16 is provided with a dimple 17 to further enhance the possible number of connecting and disconnecting operations.

Also shown in FIGS. 7*a*, 7*b*, and 7*c* is a rib 18 arranged in the axial direction of each contact terminal 10 in order to enforce the rigidity of each of the contact terminals 10.

Figure 8A:
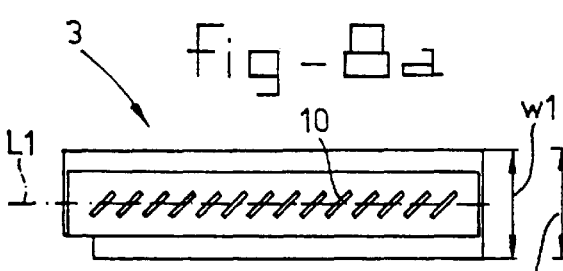
FIG. 8*a* and FIG. 8*b* show, schematically, different possible orientations of the spring contact member 22 relative to the housing of the connector block.
Figure 8B:
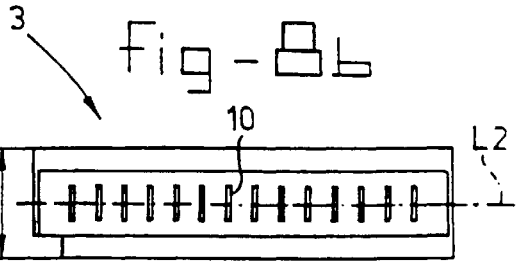

FIG. 8*a* and 8*b* show two different possible orientations of the spring contact members 22. both FIGS. 8*a* and 8*b* show schematically top views of a connector block 3 having contact terminals arranged along one line L1. In the embodiment shown in FIG. 8*a*, the spring contact members 22 have an angle of inclination relative to line L1 smaller than $\pi$, whereas in the embodiment shown in FIG. 8*b* the angle of inclination between the spring contact members 22 and line L1 is substantially $\pi$. The advantage of the embodiment according to FIG. 8*a* is that the width W1 of the connector block 3 may be smaller than the width W2 of the connector block 3 in the embodiment according to FIG. 8*b*.

FIG. 9 schematically shows a connector block 3 which is provided with a ground conductor 19. The ground conductor 19 is, during operation, connected to ground, e.g. through a contact pin connected to a ground layer on a printed circuit board to which the connector block 3 is connected. The purpose of the ground conductor 19 is to provide a static discharge capability for selected contact members 22, e.g. those contact members 22 which are connected to (C)MOS circuit parts on a printed circuit board.

FIG. 10*a* shows a cross section through the connector block 3 according to FIG. 9 along line X—X, whereas FIG. 11*a* shows a cross section through the connector block 3 according to FIG. 9 along line XI-XI. FIG. 10*b* shows an enlarged view of the ground conductor 19 from the cross section of FIG. 10*a*, whereas FIG. 11*b* shows an enlarged view of the ground conductor 19 from the cross section of FIG. 11*a*.

FIGS. 10*a* and 10*b* show that each of the contact members 22 may be provided with an extension 21 at the extremity part of the corrugated spring part 13 adjacent to the ground conductor 19. In the disconnected state of the connector block 3 the extension 21 is forced to the extremity of the cavity within the insulating housing 11 of the connector block by the spring action of the corrugated spring part 13. The extension 21 shown in FIGS. 10*a* and 10*b* is insulated from the ground conductor 19 by a wall part of the insulating housing 11. Consequently, there is no electrical contact between the extension 21, and the ground conductor 19 and no static discharge capability is provided for.

However, the extension 21 of the contact member 22 shown in FIGS. 11*a* and 11*b* electrically contacts the ground conductor 19 when the connector block 3 is not connected to a cradle connector 2 and the extensions 21 is forced to the extremity of the cavity within the housing 11. No insulating wall is present between the ground conductor 19 and the extension 21 in FIGS. 11*a* and 11*b*. Therefore, any static charge on the contact member 22 in FIGS. 11*a* and 11*b* will be conducted to ground through the ground conductor 19 when the connector block 3 is disconnected. Static charges on the contact member 22 of FIGS. 11*a* and 11*b* are not able to damage (C)MOS circuit parts on a printed circuit board connected to contact pin 9.

The ground conductor 19 in the embodiment shown in FIGS. 9, 10*a*, 10*b*, 11*a*, and 11*b* is made of a small rod from any suitable metal, e.g. phosphor bronze. However, it is also possible to provide a ground conductor strip 19' instead of a rod 19: FIGS. 12*a*, 12*b* and 12*c*. The ground conductor strip 19' may be applied to the inside wall of the insulating housing 11 of the connector block 3 by means of a method for selectively metallization of plastic connectors as described and claimed in European patent application 94292140.3. The ground conductor strip 19' is connected to ground, e.g. on a printed circuit board to which the connector block 3 is fixed, by suitable conductor means (not shown).

FIG. 12*b* shows a cross section through a cavity 24 in which the ground conductor strip 19' is exposed to electrically contact part 21 of spring part 13 when the connector block 3 is in its disconnected state. FIG. 12*c* shows a cross section through a cavity 24 in which the ground conductor strip 19' is covered by an insulating layer 25 to prevent electrical contact between the strip 19' and the part 21 of the spring part 13 in this cavity 24.

FIGS. 12*a* and 12*b*, the latter showing an enlarged view of a construction detail of FIG. 12*a*, also show by-pass strips 20 provided on the inside wall of the cavity in which the contact member 22 is accommodated. As is clearly shown in FIG. 12*b* the ground conductor strip 19' and the by-pass strip 20 are separate from each other and do not contact each other directly. The purpose of the by-pass strip 20 is to electrically contact as many U-shaped bases of the spring contact member 22 as possible and therefore to provide a short circuit for any electrical current through the contact member 22. The application of by-pass strip 20 reduces the electrical resistance between the contact terminal 10 and the contact pin 9 from each of the spring contact members 22. A by-pass strip 20 may be provided at both sides of each of the contact members 22, as shown in FIG. 12*a*. However, one by-pass strip 20 may be provided instead. The by-pass strips 20 may be applied on the inside walls of the cavity by the method for selective metallization of plastic connectors described in European patent application 94202140.3, referred to above. However, any other method for selective metallization may be used. Alternatively, a metal sleeve may be used, surrounding the spring contact member 22.

In order to ensure the best operation of the by-pass strip 20 the corrugated structure of the spring part 13 is, preferably, designed in such a way that the extension 21 is resiliency forced against the by-pass strip 20. Then, as little current as possible is flowing through the spring part 13 itself. The surface part of extension 21 contacting the by-pass strip 20 is preferably rounded and free of any burr. Alternatively, the first part of the corrugated structure opposite to extension 21 may be resiliently forced against by-pass strip 20.

The provision of a ground conductor 19 or a ground conductor strip 19' according to any of the FIGS. 9 through 12*b* is also applicable to any other kind of spring contact member, e.g. the ball pen-type of spring members from the prior art described in the introduction. Of course, when the conductor block 3 provided with either a ground conductor 19 or a ground conductor strip 19' is connected to a mating cradle connector 2 those spring contact members 22 which electrically contact either the ground conductor 19 or the ground conductor strip 19' in the disconnected state will have to be at least slightly compressed in the connected state in order to avoid an electrical connection between the ground conductor 19 or the ground conductor strip 19' and the extension 21 during operation. In order to have such a guaranteed compression during operating those spring contact members 22 which have such a static discharge capability may extend slightly more from the body of the connector block 3 with their contact terminals 10 than to the other spring contact members 22 which do not have such a static discharge capability.

Figure 13C:
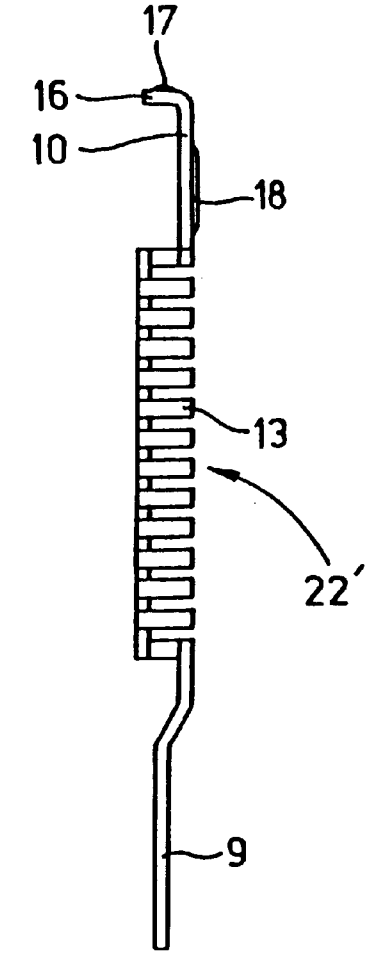
FIGS. 13*a,* 13*b,* 13*c* illustrate a method to produce a C-shaped spring contact member or a connector according to the invention.
Figure 13B:
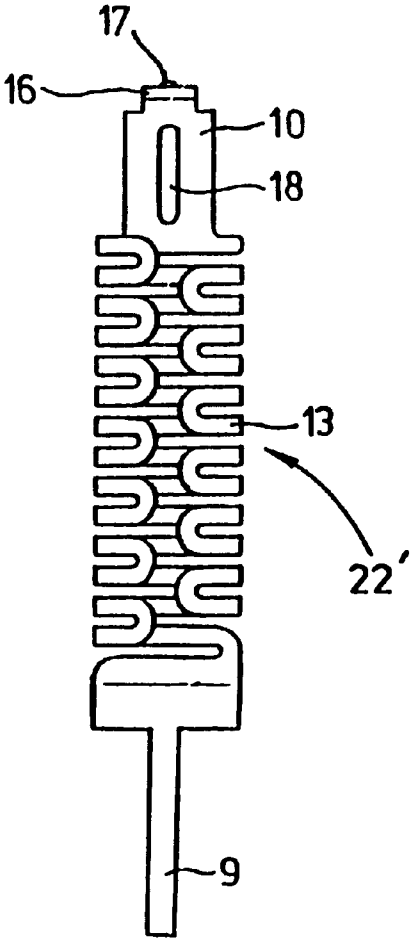
Figure 13D:
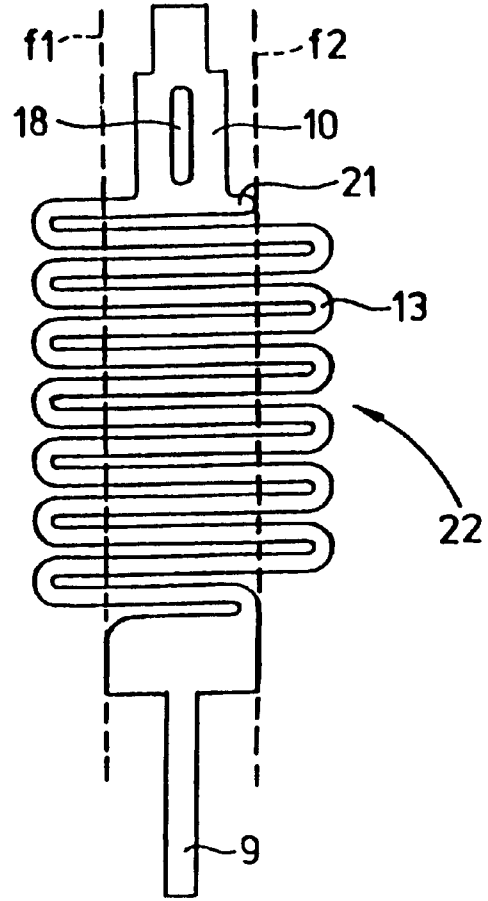

FIG. 13*a* shows an enlarged view of a spring contact member 22, preferably stamped from a thin metal sheet. FIG. 13*a* further shows two folding lines f1, f2. In order to reduce the width of a connector block 3 each of the U-shaped base parts of the corrugated spring part 13 is folded π radians about folding lines f1 or f2, respectively. FIG. 13*b* shows the contact member 22' after such a folding operation which clearly shows that the width of the spring contact member is reduced relative to the width of the spring contact member 22 according to FIG. 13*a*. FIG. 13*c* shows a side view of the spring contact member 22' according to FIG. 13*b*. FIG. 13*c* shows that the gain in width is at the cost of the space needed in a direction perpendicular to the width direction of FIG. 13*b*.

Like the original spring contact member 22 the spring contact members 22' according to FIGS. 13*b* and 13*c* may be provided with a bent extremity 16 provided with a dimple 17. Moreover the contact terminal 10 of the spring contact member 22' may be provided with a rib 18 like the original spring contact member 22.

Figure 14:
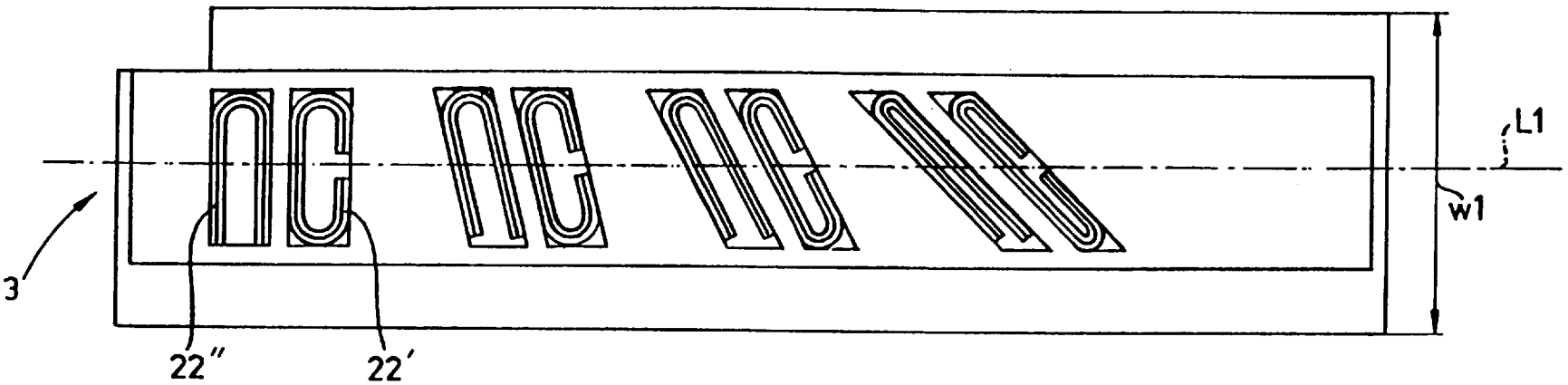
FIG. 14 shows a C-shaped spring contact member and U-shaped spring contact member within a connector block.

FIG. 14 shows several spring contact members 22' which are made in accordance with the method described above. The spring contact members 22' are shown in a top view in FIG. 14 in which they show a C-shape. The distance between the legs of the C-shaped spring contact member 22' may be varied, as required. Different distances are shown in FIG. 14. Moreover, the angle of inclination between the C-shaped spring contact members 22' and the line L1 may be varied, as required.

FIG. 14 also shows an alternative way of bending (or folding) a spring contact member 22 in order to produce an U-shaped spring contact member 22" (when seen from a top view as in FIG. 14). The distance between the legs of such U-shaped spring contact members 22" may be varied, as required. This is also shown in FIG. 14. Moreover, the angle of inclination between these U-shaped contact members 22" and the line L1 may vary in accordance with the requirements. As explained above, the larger this angle of inclination between these U-shaped contact members 22" and the line L1 may vary in accordance with the requirements. As explained above, the larger this angle of inclination the smaller the width w1 of the connector block 3 may be.

Figure 15:
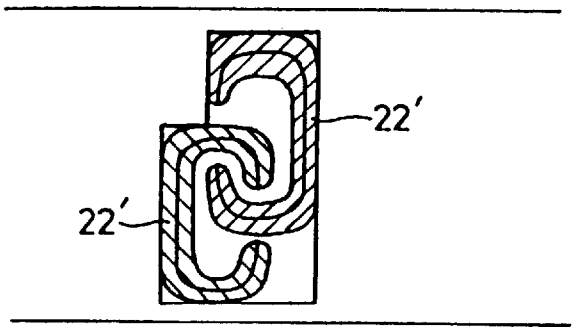
FIG. 15 shows an alternative arrangement of two C-shaped spring contact members for a connector according to the invention.

FIG. 15 shows two c-shaped spring contact members 22' produced in accordance with the method described above referring to FIGS. 13*a,* 13*b,* and 13*c*. In order to further reduce the required space for a connector block 3 the legs of two adjacent spring contact members 22' may be interlaced as shown in FIG. 15. Of course, insulating walls (not shown) between the two adjacent spring contact members 22' may be provided in order to prevent undesired electrical contact between both spring contact members 22'.

Figure 16:
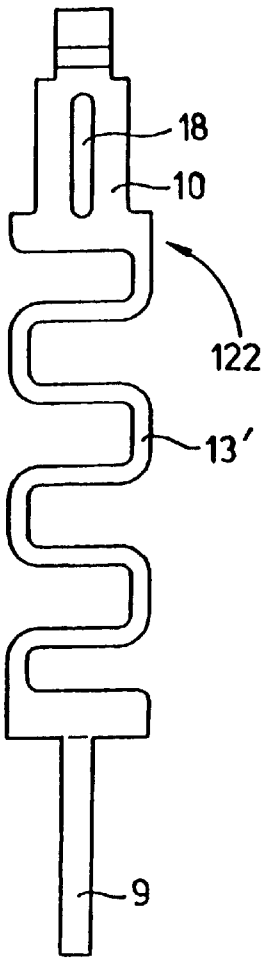
FIG. 16 shows a further embodiment of a spring contact member for a connector according to the invention.

FIG. 16 shows a further embodiment of a spring contact member 122. The spring contact member 122 differs from the spring contact member 22 (e.g. FIG. 13A) in the ratio of the distance between adjacent legs of the corrugated spring part 13' to the width of the corrugated spring part 13' as compared to the ratio of the distance between adjacent legs of the corrugated spring part 13 to the width of the corrugated spring part 13.

Figure 17B:
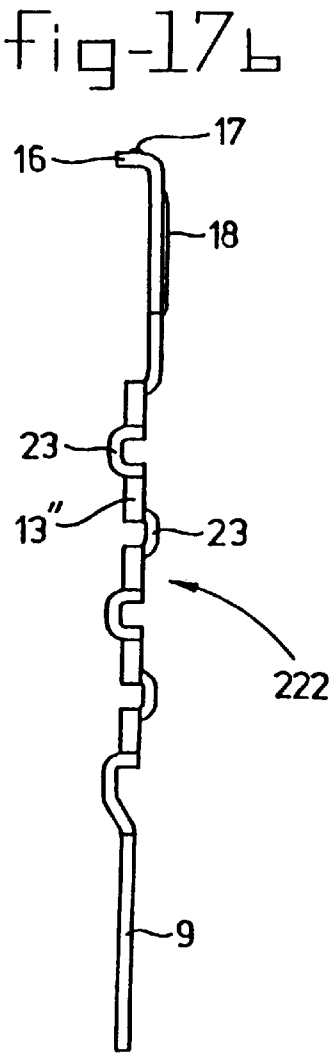
FIG. 17*a* shows a spring contact member with V-shaped corrugations for a connector according to the invention and FIG. 17*b* shows a side view of the spring contact member of FIG. 17*a*.
Figure 17A:
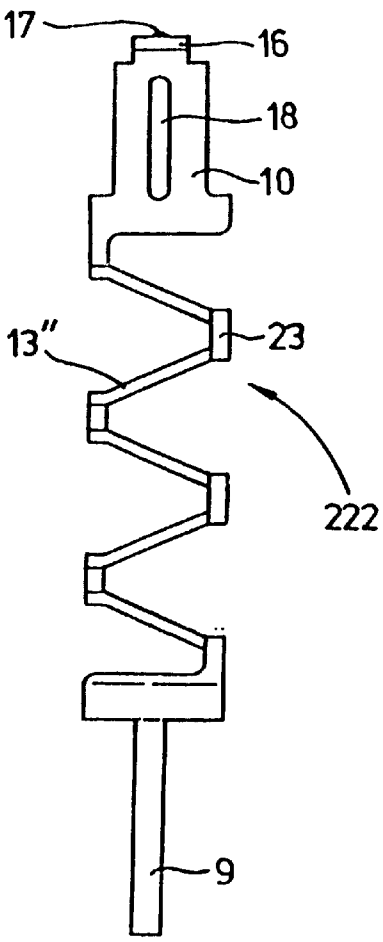

FIG. 17*a* shows that the invention is not restricted to corrugated spring contact members 22 with U-shapes. FIG. 17*a* shows a spring contact member 222 comprising a corrugated spring part 13" of which adjacent legs are arranged in a V-shape. Optionally, the base parts of these V-shapes may be bent about a predetermined angle in order to reduce the width of the spring contact members 222. The bent base part is denoted by the reference sign 23. Moreover, each of the contact terminals 10 of the spring contact member 222 may be provided with a rib 18 and with a bent extremity 16, the latter in turn being provided with a dimple 17. Adjacent bent base parts 23 may be bent in opposite directions, as shown in FIG. 17*b* which shows a side view of the spring contact member 222 according to FIG. 17*a*.

The present invention is not restricted to the embodiments shown in the figures and described above. The connector blocks provided with spring contact members according to the invention are not only applicable in hand-held telephone sets. They can be applied wherever a connector block is needed having contact members with a spring action in their axial direction. Since the spring contact members themselves are made from a single piece of metal they can be easily produced. Moreover, assembling a connector block with several spring contact members according to the invention is relatively easy since the total number of pieces is reduced.

The contact pin 9 of the contact members can be substituted by contact tips or the like suitable for hold down applications. Actually, the contact pins 9 may be substituted by any type of contact terminals known to a person skilled in the art. Moreover, they may extend from a side face of block 3 instead of from the face opposite to contact terminals 10.

It is to be understood that wherever the expression "axial direction" of the contact members 22, 122, 222 is used a direction substantially coinciding with the axial direction of the contact terminals 10 is meant.

We claim:

1. Connector block (3) comprising at least one contact member (22), each contact member being integrally made and provided with a first contact terminal (10) for electrical contact to a contact member (6) of a mating electric element (2), a second contact terminal (9) and a spring part (13) giving the contact member a resilient capacity in a predetermined axial direction, the connector block (3) also comprising a shorting rod (19) electrically predetermined contact members (22) when the connector block (3) is in its disconnected state and being electrically separated from said predetermined contact members (22) when the connector block is in its connected state, characterized n that each spring part (13) has a corrugate d structure and is accommodated in a separate cavity (24) within the connector block (3), the shorting rod (19) extending within the body of the connector block and being partly exposed in predetermined cavities (24) and in that each of the first contact terminals (10) is provided with a bent extremity and a rib (18) arranged in the axial direction of the first contact terminals.

2. Connector block (3) comprising at least one contact member (22), each contact member being integrally made provided with a first contact terminal (10) for electrical contact to a contact member (6) of a mating electric element (2), a second contact terminal (9) and a spring part (13) giving the contact member a resilient capacity in a predetermined axial direction, the connector block (3) also comprising shorting means (19') electrically contacting predetermined contact members (22) when the connector block (3) is in its disconnected state and being electrically separated from said predetermined contact members (22) when the connector block is in its connected state, characterized in that each spring part (13) has a corrugated structure and is accommodated in a separate cavity (24) within the connector block (3), the shorting means comprising at least one shorting strip (19) extending on the surface of the body of the connector block (3) and being exposed in predetermined cavities (24).

3. Connector block according to claim 1, characterized in that each of the extremities (16) is provided with a dimple (17).

4. Connector block according to claim 1, characterized in that each of the spring parts (13) extend in a substantially flat surface and are provided with U-shaped or V-shaped interconnected parts.

5. Connector block according to claim 4, characterized in that the interconnected parts are provided with legs and base parts interconnecting the legs, the width (x) of the legs differing from the width (y) from the base parts.

6. Connector block according to claim 4, characterized in that the contact block comprises a plurality of said contact members (22) arranged along a line (L1) and said flat surfaces are inclined relative to said line (L1).

7. Connector block according to claim 1, characterized in that each of the spring parts (13) are provided with U-shaped or V-shaped interconnected parts provided with legs and base parts interconnecting the legs, at least some of the spring parts (13) being folded in such a way that they show a substantially c-shaped or U-shaped cross section seen in the axial direction of the contact members.

8. Connector block according to claim 1, characterized in that each of the spring parts (13) are provided with U-shaped or V-shaped interconnected parts provided with legs and base parts interconnecting the legs, at least one pair of adjacent spring parts (13) being folded in such a way that they show substantially C-shaped cross sections seen in the axial direction of the contact members, the C-shaped cross sections being interlaced.

9. Connector block according to claim 1, characterized in that those contact members (22) which are accommodated in cavities (24) in which said exposed shorting rod (19) extends slightly more from the body of the connector block (3) than do the other contact members (22).

10. Connector block according to claim 1, characterized in that those contact members (22) which are accommodated in cavities (24) in which said exposed shorting strip (19') extends extend slightly more from the body of the connector block (3) than do the other contact members (22).

11. Connector block according to claim 1, characterized in that each of the cavities (24) are provided with a by-pass strip (20) for reducing the electrical resistance between the first terminal (10) and the second terminal (9) of each of the contact members (22).

12. Connector block according to claim 1, characterized in that the spring part (13) is provided with a part (21) close to the first terminal (10) and is designed in such a way that said part (21) is resiliently forced against the by-pass strip (20).

* * * * *